United States Patent [19]

Gomez-Olea Naveda

[11] 4,416,127

[45] Nov. 22, 1983

[54] MAGNETO-ELECTRONIC LOCKS

[76] Inventor: Mariano Gomez-Olea Naveda, Vuelta del Castillo, 3 - 5° A, Pamplona, Spain

[21] Appl. No.: 267,859

[22] Filed: May 28, 1981

[30] Foreign Application Priority Data

Jun. 9, 1980 [ES] Spain ..... 492254

[51] Int. Cl.[3] ..... E05B 19/00; E05B 47/00

[52] U.S. Cl. ..... 70/276; 70/278; 70/395; 70/413

[58] Field of Search ..... 70/276, 413, 277, 278, 70/395, 383, 384; 335/206, 207

[56] References Cited

U.S. PATENT DOCUMENTS

| | | | |
|---|---|---|---|
| 4,232,819 | 11/1980 | Bost | 70/413 |
| 4,287,733 | 9/1981 | Gomez-Olea | 70/276 |
| 4,317,156 | 2/1982 | Stangl | 70/413 |
| 4,331,013 | 5/1982 | Jaulmes | 70/276 |

*Primary Examiner*—Robert L. Wolfe

*Attorney, Agent, or Firm*—Wenderoth, Lind & Ponack

[57] ABSTRACT

A magneto-electronic lock includes a key body having a magnetic combination. In the interior of a receiver of the key body are arranged magnetic detectors, a bolt, and an electronic circuit device connected between the bolt and the detectors. Positive and negative magnetization devices cooperate, depending on the position thereof, in opening, closing or blocking an electronic circuit including an electric opening pulse of a gate. A device determines the electric continuity both in the key and in the receiver thereof. An electric derivation device opens a code. Passive positive and negative relays are in combination with positive and negative magnetic elements. Positive and negative magnetic devices have potentials to act on the passive relays in the contact threshold. Positive and negative magnetic members, in combination by proximity to the passive relays, act thereon with an opposite polarity maintaining the relays static in view of a mean potential, and change the conduction state of the relays when magnetic elements having a higher potential are juxtapositioned. A multiple contact connector is capable of being combined with the code.

19 Claims, 11 Drawing Figures

MAGNETO-ELECTRONIC LOCKS

BACKGROUND OF THE INVENTION

Present day tendencies in the field of locks is to provide locking devices in which a mechanical key, conventionally used together with a mechanical lock, is avoided due to the reduced number of different keys which can be made for each type and the ease in opening by means of picklocks. An increase in the number of points of such locks has been suggested to thereby increase the number of combinations, but a mechanical problems and the substantial increase in price have resulted.

There are known devices which, by means of electric, contacts having calibrated resistances, light conductions, etc., produce electric pulses which, when combined, electrically activate a bolt.

Another device activates magnetised pieces, located in the interior of the receiver of the key body, by means of other magnetised pieces, located in the interior of the key body, so that when arranged in a programmed position they permit a mechanical movement or they control electrical contacts for the activation of moment of a bolt.

In other devices the key body is comprised of cards having electric or magnertic circuits which, when inserted in a receiver, are read by reading heads and transmit, by means of a computer, an opening signal to the bolt.

These devices have various and different disadvantages. All these systems in general, and those based on printed cards in particular, are extremely expensive and highly complex, wherefore they are not accessible to the general public. Activation of any of these systems which use any type of contact between the key body and the receiver of the key body may be prevented by dirt, such as dust, grease, etc. or any other obstacle.

In general, all systems which use an accessible receiver in which the opening code or key is contained, can be activated by persons skilled in the art. This occurs with locks having a mechanical key and with those having magnets operating on other magents. Besides the latter locks can be operated without the appropriate key since the magnets situated in the receiver provide an indication of the position of the magnets contained in the key body, wherefore a negative of the key is readily obtainable.

Furthermore, in any system which individually differentiates the receiver of the key body for each unit and whose operating code is, therefore, in the receiver, can be operated by an expert, and since the receiver is not an identical piece, it cannot be mass-produced at a low cost.

SUMMARY OF THE INVENTION

The present invention relates to improvements in magneto-electric locking systems of the type comprising a key body having a magnetic combination, a receiver of the key body in the interior of which there are disposed magnetic detectors, a bolt, and an electronic circuit device connected between the bolt and the detector. The system of the invention includes a positive and a negative magnetisation means which cooperate, depending on the position thereof, in the electric conduction, opening, closing or blocking of an electronic circuit including an electric opening pulse of a gate; a means for determining the electric continuity both in the key and in the receiver thereof; an electric derivation means for opening a code; a passive positive and negative relay means in combination with a positive and negative magnetic elements; the positive and negative magnetic means have potentials which act in a contact threshold, by proximity, on the positive relays so as to thereby maintain them open, passing to the conduction stage thereof when magnetic elements having a mean potential and an opposite polarity are juxtapositioned; positive and negative magnetic means which act on the passive relays when moved away and brought nearer, using a magnetisation value acquired by the permanent or transistory relays; a transmission, conduction and deflector means for the magnetic flow which act, in combination with magnetic elements, on the passive relays; positive and negative magnetic means which, by means of their movement, act on passive relays; conductor loops, coils or electromagnets, positive and negative, which when an electric current is passed through their loops, generate a positive or negative magnetic field which acts on the passive relays; a multiple contact connector means capable of being combined with the key; a means for supporting strips of passive relays and magnetic elements, triggered, integrated and fixed by soft soldering and capable of bearing printed or cabled circuits; a compact support means, forming a block, integrating the magnetic elements and passive relays; positive and negative conductor loops which, by bringing them nearer to or by moving them away from the magnetic elements, generate positive and negative currents and the combination of which acts on an electronic circuit to produce opening of the gate.

The object of the present invention is to proportion said system with a very high number of combinations so that it is humanly impossible to ascertain the code of each opening, providing it with magnetic elements and detectors, the type, physical shape, mode of operation and force of which are variable.

Another object of the present invention is to provide said system with receivers of the key body identical for a high number of different keys, providing it with connectors for the terminals of the magnetic field detectors and a connector circuit, both of which are hidden and have multiple input and output voltages to the electronic operating circuit.

A further object of the present invention is to provide said system with various modes of operation, so that, either by introduction or by attachment of the key body in the receiver, the key can be static, sequential or combinatory, the dirt and obstacles which prevent operation thereof being readily eliminated.

A further object of the present invention is to provide said system with special supports for the detectors and magnetic elements, to facilitate manufacture and series-assembly thereof, combining various geometric shapes to increase the versatility and adaptability thereof to the different known electric and mechanical locking systems, but with reduced and manageable dimensions.

Therefore, the object of the present invention is to improve keys and electro-magnetic locking systems and the applications thereof.

These objects are obtained, in accordance with this invention, in a locking system which uses magnetic field detectors. We refer to those which, due to the effect of a magnetic field which is close thereto but not necessarily in contact therewith, change the position of the potential or produce or permit the passage of current through the terminals thereof or prevent same. Known elements usable in this invention are, among other, micro-contacts, high-vacuum reading relays having one or more contacts, mercury micro-relays, conventional miniature relays, miniature coils, miniature electromagnets, semiconductors, Hall effect devices, electronic memories which can be positioned by a magnetic field, whether of ferrite, magnetic bubbles or bioelectric circuits, resistance plates which are variable by means of the interaction of a magnetic field on said plate, and crystalline structures in which the erratic or non-erratic movements of the free or freeable electrons are varied due to the magnetic field.

We shall add, as a modality of reading relays or reed switches, those formed by conductor elastic strips charged with magnetisable material, mounted in the air and attached to an insulating and non-magnetisable base. These strips will make contact with each other when a magnetic field is arranged close thereto. To all these can be incorporated a magnetic element which enable them to be close to the actuation threshold or to by-pass it slightly, and at such a distance that they are ready to be activated or deactivated.

All these magnetic field detecting elements shall be referred to as passive relays or magnetic detectors, unless in a specific case the particular name thereof is mentioned.

Since all the magnetic detectors to be actuated at a pre-established distance and position by a magnetic element require lines of force or a minimal magnetic induction, it is understood that by increasing the induction, the actuation distance can be increased. This induction can be increased by incorporating another element which produces or transmits a magnetic field to the passive relay, but at such a distance, at such a position and with such an induction that the passive relay is very close to the induction threhsold for activation thereof or it bypasses such threshold slightly, whereby it will be maintained activated. Thus, due to the polarity of this incorporated magnetic field, the magnetic element which should activate the passive relay should have a smaller induction and should be positioned precisely oriented with one of its two polarities.

In the event that the passive relay is already activated, as in the case of dual-contact relays, these latter can be improved, combined or substituted for by single passive relays, but incorporating mangnetic element, then the magnetic element should deactivate the passive relay and should have the necessary induction and be positioned with one of its polarities oriented, since with the other magnetic element incorporated into the relay, the relay can only be activated with one polarity and not with the other.

Within this type of activation and deactivation, there are other modes of operation. For example, the magnetic element incorporated into the passive relay can be positioned parallel, being fixed to the passive relay, or perpendicular thereto and, therefore, to activate same the position of the activating magnetic element should be varied, which element should furthermore act with one of its two polarities oriented and could be positioned in turn to operate perpendicular to or parallel to the passive relay, but in each case it should be activated in a different position. Another mode of operation is based on the principle that when a magnet is brought close to a passive relay this is activated from a maximum determined distance and then if the magnet is moved away it is still activated until a distance generally greater than the first is reached. There is, therefore, a certain magnetic catch or spring. This property can be utilized so that the same key can operate different key receivers, prepared for such effect, since while in a receiver the key is lead to a certain level or position and can operate a bolt, in another receiver the key should reach another level or position and should activate certain relays and should return to another closer position where it activates other relays which should also be activated to operate the bolt.

It is known that the magnetic field can be dispersed and deviated by means of certain diamagnetic elements close to the field, such as bismuth, or they can be concentrated and corrected by means of other paramagnetic elements, such as iron, nickel, cobalt and steel, considered as the strongest paramagnetic agents, wherefore they are known as ferromagnetic. These properties are used in this invention to deviate, reduce or increase the magnetic field by means of the corresponding strategically placed pieces and, thus, to activate or deactivate any desired passive relay to obtain a higher number of possibilities and, therefore, combinations.

Due to all these changes, and by varying the longitudinal and transversal distance, the position, the induction, and the polarity of the magnetic elements incorporated in the key body, the opening code is varied and therefore the number of combinations is substantially increased.

On the other hand, the magnetic elements, whether they should activate or deactivate the passive relays, can be either producers of the magnetic field by themselves, such as permanent magnets, coils and electromagnets, or they can merely be magnetic flow transmitters, as in the case of ferromagnetic materials and soft iron, since these concentrate the lines of force and can deviate the magnetic field. We refer to soft iron since, differing from ferromagnetic materials, it looses magnetism when the inducing magnetic field no longer actuates, and since it does not conserve the magnestism it is ideal to prevent the operating positions from being detected and the original conditions can be referred to.

While the magnetic detectors or passive relays should be fixed in the interior of the receiver, the magnetic elements incorporated to the relays and/or the activation relays can be movable.

To cover all the described needs, some or all of the magnetic elements which intervene can be permanent, i.e. magnetised originally or magnetised totally or partially. For the manufacture of this invention, they can be magnetised before assembly thereof or once installed. With respect to the use thereof, they can be magnetised before operating in the opening position or once the key is situated in said position. With respect to the passive relays, the magnetic elements can operate with the poles situated longitudinally, transversally or obliquely.

These modalities give an idea of the versatility of this invention, since using one modality or the other and modifying the size and the shape of the key, innumerable types and classes of different keys can be obtained.

Once the magnetic detectors, which are going to be used in the interior of the receiver have been chosen and the magnetic elements are disposed in the key body in certain pre-established positions and polarities, the detectors which should be actuated by the magnetic elements can then be positioned. Those detectors which should not be actuated by the magnetic elements could be positioned only in some strategic points or the complete remaining surface could be filled therewith. The terminals of the single contact activated positive detectors could be series-connected and the terminals of the single contact operated or not, but negative, detectors could be connected in parallel, so that if any of them were activated, the bolt would not be operated, the alarm rings and/or a blocking of the system takes place.

When dual contact detectors are used, i.e. having three terminals, the terminals of the closed contact of the activated detectors should be connected in series between them and the terminals of the closed contact of the non-activated detectors. The terminals of the open contact of the non-activated detectors will be connected in parallel so that if any one of them were activated, the same will take place, i.e. the bolt is not operated, the alarm goes off and/or the blocking of the system takes place.

The mode of connecting the terminals of the magnetic detectors depend on the electronic circuit used. Therefore, there are other modes of connection.

Based on the use of the NOR, AND and NAND gate system, one end of each and every one of the detectors is connected to a common terminal, the other end of each detector being free to be connected to a system of terminals so that those detectors which should be activated, emit a positive signal and those which should not be activated emit a negative signal.

In the event that only one of the negative detectors should be activated, the final signal will be negative, and only in the event that all the positive detectors should be activated and that none of the negative detectors should be activated, will the signal be positive. A time necessary for the activation of the detectors can be established since, when the key body is introduced, a negative detector can be activated, while passing, until the final position is reached. For example, if a negative detector is activated for more than half a second, the negative signal will be the definite one and, therefore, the gate will not be opened. Therefore, for the positive detectors there will be established a longer time than that for the negative detectors, for example, three-quarters of a second, to permit the key body to reach the position of all the positive detectors, although a negative detector has momentarily been activated during the travel, and if a negative detector is activated it will always be activated before the positive detector, preventing the gate from being opened.

In all these cases, connection can be made during the assembly of the receiver, joining some terminals with other,s but this obliges each key receiver with a single key body to be used.

To improve this process, all the terminals of the detectors are connected to the terminals of a connector, which will only be accessible from the inside or a hidden and closed spot, and to this connector there is coupled a printed or cabled circuit cable of being coupled to the preceding connector. Therefore, it is also a connector which shall be referred to as a circuit-connector, which will bear all the necessary connections to be carried out depending on the code of each specific key. Thus, to operate the bolt it will only be necessary to incorporate a circuirt-connector, hidden in the receiver, and to use the corresponding key body. This implies the important advantage that identical key receivers can be made for a high number of key bodies. Thus, since they can be manufactured on large mass-produced scales, the cost thereof is reduced to a minimum. Each circuit-connector will necessarily be supplied with it corresponding key, while the key receiver could be supplied separately and undifferentiated, since it is the same for all the keys. Each circuit-connector could serve for a group of different keys, for example, turning it or changing the position thereof.

An intermediate connector having a cable or a, multiwire cable, whose length depends on the needs, can be installed. One end is coupled to the connector and the other to the circuit-connector. In this way the position of the circuit-connector, where the code is housed, can be further hidden, so that it will not be accessible inasmuch as its hidden position is not known.

The connecting circuit of the circuit-connector should be cabled or printed according to the code defined by the detectors, since they should be activated, deactivated or not activated, depending on the established magnetic combination.

The mode of coupling and the physical shape of the connectors are very varied in the art. There are known and can be used in this invention, joining connectors, card connectors, compact type connectors, printed strip connectors, etc., having guides and distinctive characteristics to carry out coupling in the exact and correct position thereof. As can be seen from the above, the circuits-connectors can be made from any known type of connector and between the coupling of terminals, but the circuit or code will be printed or cabled on the surface of the connector and between the coupling points with the terminals of the detectors, and since they are cabled they could be desmounted and the position thereof can be changed to obrain a new code.

The circuit-connector can be programmed by using a microprocessor which, detecting the positions of the magnetic pieces of the key in a testing key receiver generates, when the key is inserted therein, the programming orders of said circuit-connector rapidly and automatically, giving rise to a memory circuit of the ROM type usable with the key body to which the mentioned key is destined. This substantially reduces the costs of manufacture of the circuit-connector.

The use of connectors and, therefore, of identical key receivers proportions advantages, among which we shall point out that various bolt systems can be operated with a single key, i.e. they should in this case incorporate the same connector and the same receiver and by appropriately preparing the connector, a key can be used as a master of others, and each one of these can, in turn, be masters of others, and so on.

This takes place reserving a combination for the master key which should be incorporated to all the connectors of the receivers and this combination will always be independent of that in each key receiver, so that this will activate the master key and it will also operate all the bolts.

Since the number of combinations is so high, to be able to compute the number of different codes that can be formed, it is necessary to reduce the complexity of the system. Therefore, for such calculation the static system, not sequential nor combinatory, is used and the same receiver and only the positions of the magnetic elements in the key body are varied and, therefore, a circuit-connector is considered for each key.

If the number of detectors installed in the receiver is N, then there are only two possibilities: P magnetic elements activate P detectors or N-P detectors are not activated. That is, groups of N elements would be formed with P of one type and N-P of the other type.

Therefore, depending on the combination, variations of the two elements with repetitions taken from N in N, i.e. two raised to N: $(2)^N$.

To calculate the number of keys with different receivers, the remaining possibilities should be introduced. To give an ideal of how the number of combinations is obtained, firstly the polarity of the magnetic element incorporated to the detector should act close to the actuation threshold as a variable factor. The magnetic elements should then have three positions: North, South and a space, wherefore the code number will be: $(3)^N$.

Secondly, there should furthermore be detectors which are activated, slightly exceeding the activation threshold thereof which should be deactivated. Then the magnetic elements will have five positions: North activator, South activator, North deactivator, South deactivator, and a space. Thus, the number of combinations would be $(5)^N$.

Thirdly, the incorporated magnetic elements with their poles perpendicular or parallel are attached to the passive relays, wherefore the magnetic elements will have 9 positions: N-activator parallel, S-activator parallel, N-activator perpendicular, S-activator perpendicular, N-deactivator parallel, S-deactivator parallel, N-deactivator perpendicular, S-deactivator perpendicular, and a space. Thus, the number of combinations would be $(9)^N$. Thus, four million combinations are reached with 7 relays. That is, using only 10 passive relays 3,486 million combinations are reached.

To give an idea of the possibilities, we shall indicate a specific case in which 79,766 trillion combinations are reached with 24 relays, and this is readily obtained by housing the relays in circular key receiver having 30 mm. in length and an also circular key body having 6 mm. in diameter, perfectly reduced and manageable dimensions. The number of different keys for the same receiver will, in this specific case, be: 16 million.

It can readily be understood that the key body can have any geometric shape. Thus, activation can take place by introducing the key body in the key body receiver or merely by applying or attaching one surface to the other.

For each key to be correctly positioned, it should incorporate some positional distinctive. In the case of a circular key by introduction and with non-sequential actuation, it should have a makr, projection or distinctive which forces the correct opening position and thus direct the movement of the key body to a single position. And for combination locks by a sequence of pulses, the circular shape without any projection can be conserved. In the case of introduction, irrespective of the straight section of the key, a combination lock by a sequence of pulses can be made by inserting and withdrawing the key body at different positions of its length.

In the version of mere attachment or application, the established actuation area is hidden since one or more blocks can be made with the detectors and there can be in sight only one or various zones or fixed plates on which there will be applied another plate or zone corresponding to the key body, the fixed plate being capable of having a surface different to that of the key body to prevent an intruder from locating the actuation point, even though he is in possession of the appropriate key body, and even incorporating alarms and blocks in all those points where the key body should not actuate. This can be applied to the case of the introduction, since the plate can be formed by multiple orifices, among which there is only one, which is that of actuation, capable of becoming more complicated if it should furthermore make a programmed sequence of movements both when introducing the same key and when sequentially changing the hole and/or introducing more keys combining them simultaneously and/or sequentially.

Some of the shapes which can be adopted by the key body for the version of mere attachment, could be that of a ring or bracelet which includes the activating elements.

To facilitate mass production, both the magnetic elements and the detectors or passive relays can be mounted on standard supports.

The detectors or relays can be included to form part of a compact body which is mounted on the wall of the receiver of the key body. Then when using the version of the connector, i.e. using the same receiver body for all the key bodies, the terminals of the passive relays should be accessible from the inside so that, by changing only the connector, the code can be changed, i.e. the key body.

This compact body of the receiver should mainly be formed of non-magnetisable material and it should have the same inner geometrical shape as the outer part of the key body. The passive relays can also be incorporated in a flexible strip bearing the relays since when mounting takes place, it should only be attached to the interior of the body of the receiver. Since the polarity and the intensity of actuation of the relays can be varied both in the versions of the compact body and the strip, one or various layers, superimposed bodies or strips, concentric bodies, etc. can be provided.

In the two versions of the systems by introduction and by mere attachment, the magnets or elements which produce a magnetic combination, incorporated in the key body, can be applied in various different forms. One of them would consist in permanent magnets situated with the polarity in a longitudinal or transversal direction; in one or various modules incorporating same and these modules, in the case of a circular section, will be introduced in the key body capable of being formed by lateral recesses or at the end thereof for the adjustment and correct positioning, and corresponding to these lateral recesses, other projections in the interior of the key body and corresponding to these recesses at the end other projections at the other end of the module. Another form would consist in disposing of a key body with magnetised zones or surfaces instead of magnets. Another mode would consist in disposing of a body having properties similar or identical to that of soft iron, so that it only acquires magnetic properties when another magnetic field is close thereto and when the field moves away they are lost, and with projections which act as permanent magnets but only when the key body is applied. This soft iron will be housed in the interior of the key body. For the magnetisation thereof, being incorporated in the interior of the key body, a magnetic body or permanent magnet can be used, as well as an electromagnet or electromagnets or coils or Rowland rings, but they will have projections which will form the magnetic circuit together with the body and the soft iron projections of the key body, necessary to obtain the magnetic flow which will activate the passive relays located in the interior of the receiver. Both the soft iron projections and the projection of the permanent magnet or of the Rowland ring, should be juxtapositioned with a certain displacement for the activation of the passive relays, i.e. the relays act in the zone of the gaps of the magnetic circuit thus formed. Although the body provided with projections which is disposed in the interior of the key body can, as indicated, be of soft iron, they can also be of a ferromagnetic material. The use of soft iron or its equivalents has the advantage that the magnetic field cannot be detected, since this does not exist as produced by the same material.

Another form would consist in utilising the Hall effect elements which exist in the industry integrated in flexible strips or plates. These elements would be situated in the interior of the key body, as a plate encircling the body. Once the magnetic field of these elements is changed, they are then activated. Therefore, in the interior of the key body there will be situated soft iron pieces which, when situated in front of these detectors, will modify the magnetic field thereof and will only activate those which should be positive, depending on the code. The magnetic field to be modified should be incorporated in the proximity of the detectors but should not activate them.

Although the electromagnet, as indicated, is in this case located in the interior of the receiver, it can also be located in the interior of the key body. Thus, they will be micro-electromagnets whose activation depends on a reference voltage which can be located both in the body of the same key, as a self-generating power source, or in a given case, said voltage can be derived from the key receiver, once situated in the opening position, for example, by activating a single relay which will act as a switch.

Plates which are absorbed or deviated or dispersed in the magnetic field produced, can also be incorporated in the interior of the key body and/or the interior of the receiver, thus they activate or deactivate certain relays, which would, on the contrary, produce blocking or-/and alarm.

Since the electromagnets produce a magnetic field when current passes through the coil forming them, this property can be used in this invention, since within the key body, within the receiver or within both, miniature electromagnets are positioned with the terminals of the coils corresponding to the electromagnets which should be activated connected to a power source.

To facilitate the process of mass-production when the key bodies incorporate the electromagnets, these will be identical, but the key body will be provided with insulating connectors so that only the terminals of the coils which should be activated to establish the program, are zctivated leaving the others insulated from this power source.

In the case in which the coils are in the interior of the receiver, they will act as magnets incorporated to passive relays, to be activated or deactivated, depending on the program, by the magnetic fields created.

Some or all of the electromagnets both of the body and of the receiver can be replaced by any other elements which produce a magnetic field.

The magnetic detectors or passive relays should, preferably, be fixed in the interior of the key receiver, but the magnetic elements should be movable.

This is achieved by providing the key body and the receiver with recesses and projections, so that when the key body is actuated, they push or separate the magnetic elements incorporated in the key receiver and thus these are brought nearer to or moved away from the passive relays, activating them or deactivating them as required. Therefore, the key body, in spite of not incorporating magnetic elements, can produce the programmed magnetic combination.

In the case described, although the electromagnets can be situated in the interior of the receiver, they can be made as individual micro-electromagnets or micro-coils in which there is induced a small current when a magnetic field is moved by the core thereof. Then the key body should be provided with projections juxtapositioned to the coils to create the small current therein and the projections can be permanent magnets, made of ferromagnetic material or of soft iron with the already described means. Other coils which should not be activated or which, when activated, generate opposed currents will be incorporated.

The assembly of all the combinations of the coils and the connection of their terminals, will activate an electronic circuit which will conduct the current necessary to activate the bolt.

If the coils are activated which are programmed not to be activated, the current necessary to open the bolt will not be conducted.

In this case the micro-coils act as passive relays or magnetic field detectors.

Since this invention refers to an electronic device, it requires electrical power for the actuation of the bolt. In the case of failure of electric supply or breakdown of the supply battery, there can be incorporated batteries, condensers, or any other electrical power storing system, including that originating from solar plates, etc., to substitute the normal supply. This battery or power source can be incorporated in the interior of an area in which case two conductor points can be installed accessible from the outside, and in such a way that when they are bridged, for example, with a connector or jack or simply by means of a coin to the same key, for example, by means of a micro-relay acting as a breaker, the circuit of the battery or the source is shut off.

This battery or power source can be applied from the outside to these same points. Logically, it will always be necessary to use the key to obtain actuation. Since the system is electrically functioned, various mechanisms can be opened or activated at a time by using a single key.

The key body can always be installed in the receiver, in which case the code should be produced by programmed movements of the key, as previously described.

It can be seen that the actuation of the key body can be instantaneous, i.e. a very short time is required to activate or deactivate the detectors. Therefore, the receiver body of the key can be arranged with the vertical receiver open at both ends, so that when the key body is introduced through the upper part it slides under its own weight and protrudes from the lower part, effecting the sequence of programmed pulses during its passage through the interior of the receiver of the key body.

It can be understood that the key body can be formed in part or completely by the resistant key body so that, on introducing it in the key body, one or various obstacles is firstly withdrawn due to the electric operator or an electric clutch is made to act or both at the same time, and then the key body can be turned and a part of or the complete key body and thus the bolt is opened mechanically, whereby it can be applied to the conventional mechanical locking systems.

To protect the magnets from magnetic wear, the key body can be covered with a cover and a spring of paramagnetic material.

A mechanical spring activated by electrical power which compresses the key if it is not the correct one can be incorporated to the receiver.

BRIEF DESCRIPTION OF THE DRAWINGS

Other objects, features and advantages of the invention will be apparent from the following detailed description, taken with the accompanying drawings, wherein.

Figure 8:
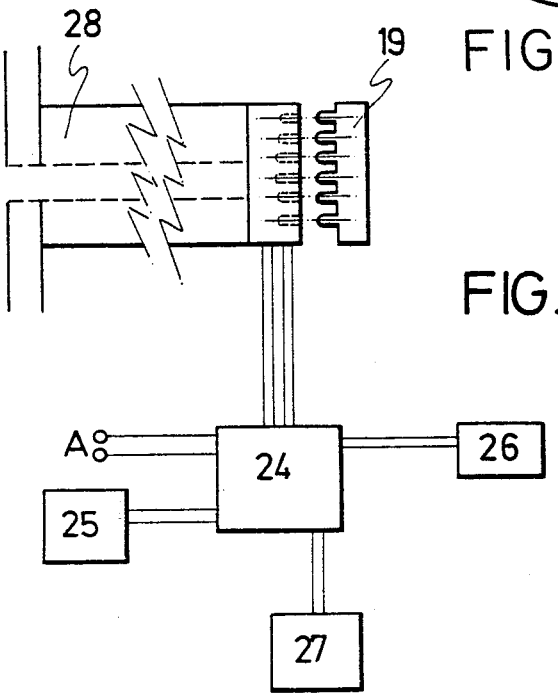
Figure 9:
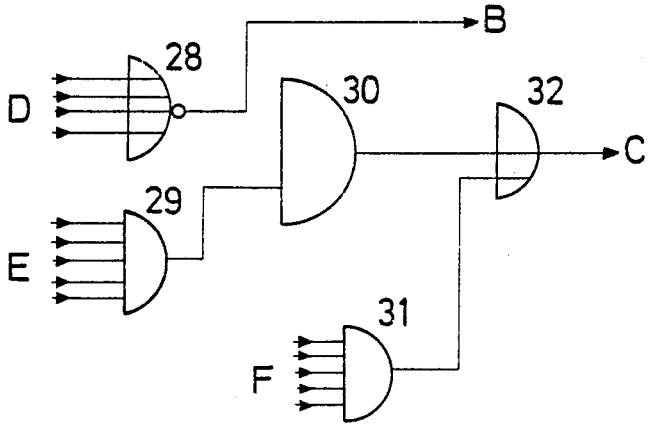

FIGS. *7a–7c* illustrate various circuit connectors;

FIG. 8 illustrates a key receiver circuit diagram;

FIG. 9 illustrates a decoding system circuit diagram; and

Figure 10:
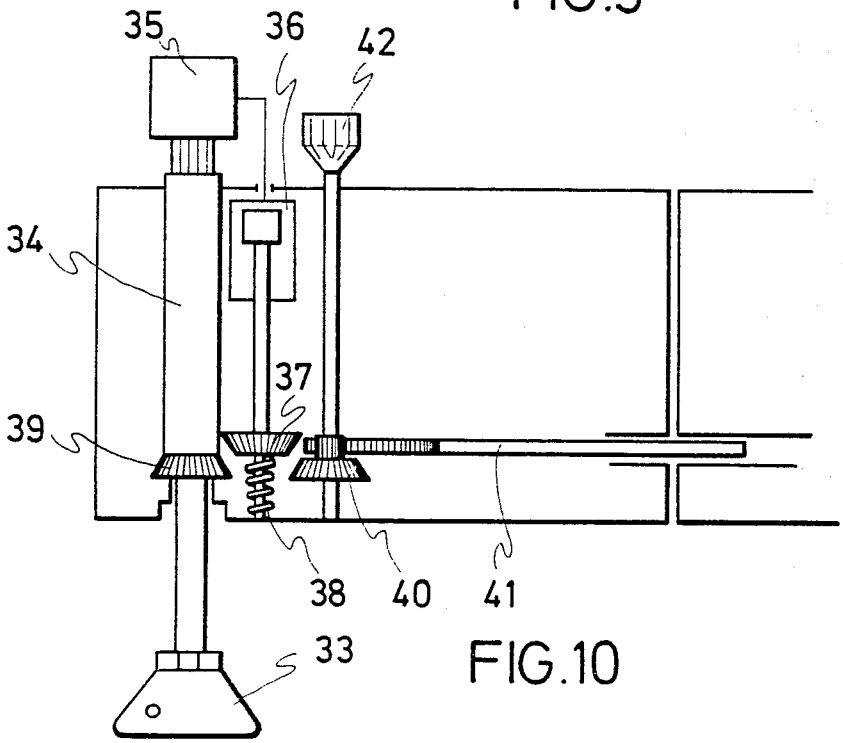

FIG. 10 illustrates a practical application of the present invention.

DESCRIPTION OF THE PREFERRED EMBODIMENTS

Figure 1:
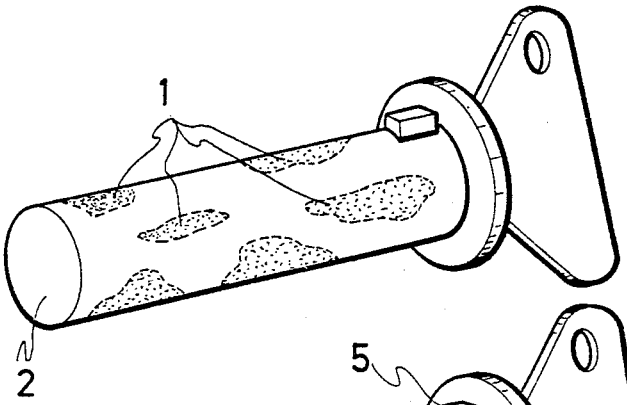
FIGS. 1 and 2 are perspective views of embodiments of keys according to the present invention.

FIG. 1 illustrates a key body 2 according to possible mode of the invention and having magnetic or magnetisable zones 1 which, as can be seen, can have very different shapes. The straight section of the key body 2 can have any closed polygonal shape although it is represented in FIG. 1 as being cylindrical.

Figure 2:
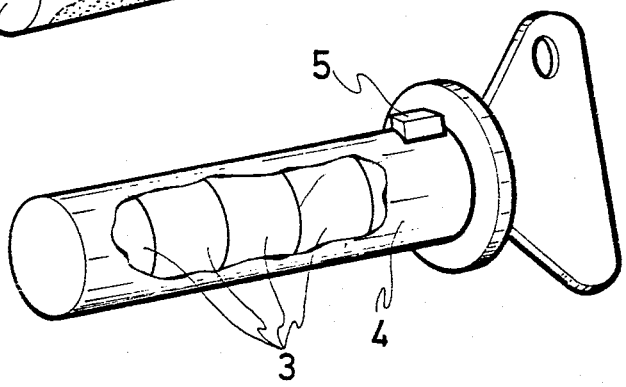

FIG. 2 illustrates the internal construction of a key body having a protecting layer 4 of non-ferromagnetic material positioned therein are various modules 3 comprising the key body. A guide 5 forces the key to be positioned in a correctly form within the key receiver.

Figure 3:
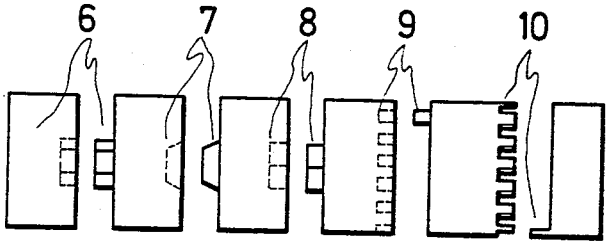
FIG. 3 is a side view of various possible socket systems which may be employed to form a key body according to the invention.

FIG. 3 is a side view of different modules of which the key body can be formed with various types of sockets, although only a single one of them can be used for the formation of a particular key, represented types of sockets are hexagonal 6, truncated 7, and square 8, concentric and eccentric crenelates 10, these not being the only possibilities.

Figure 4:
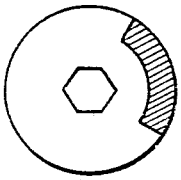
FIG. 4 is a plane view of a portion of a further embodiment of the invention.

FIG. 4 illustrates a plan view of a module with a hexagonal socket in which the magnetic or magnetisable zone is shown as hatched. In accordance with FIGS. 3 and 4, by a successive phase difference of one module with respect to the other and for the same type of module, a large number of keys can be manufactured.

Figure 5A:
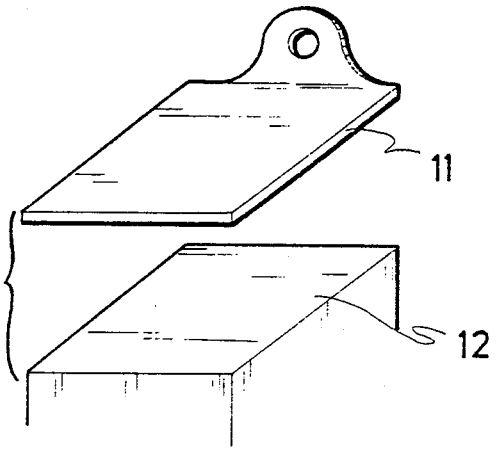
FIGS. 5*a* and 5*b* respectively show views of two types of keys.
Figure 5B:
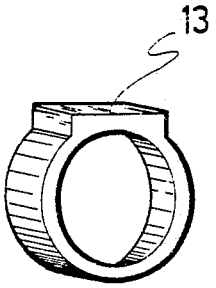

FIG. 5*a* shows a flat key 11 having a flat face to be attached to a flat face of a key receiver 12, and FIG. 5*b* shows a similar arrangement with a ring 13.

Figure 6:
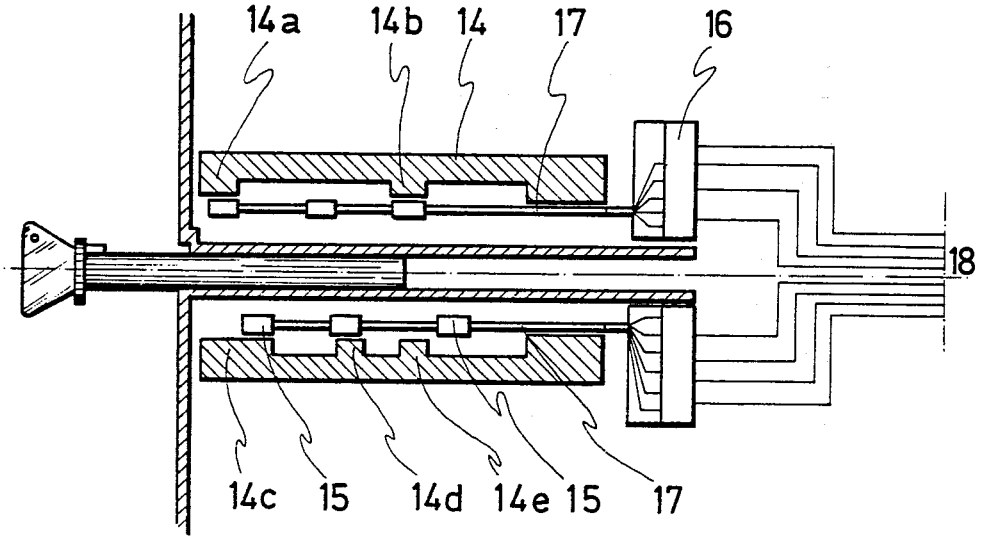
FIG. 6 is a longitudinal sectional view through a key receiver.
Figure 7A:
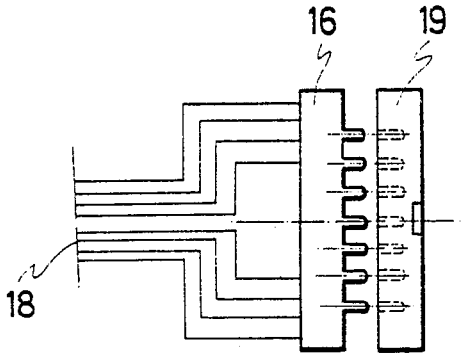
Figure 7B:
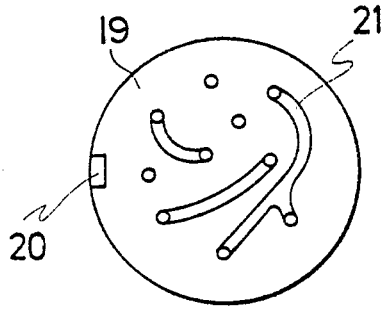
Figure 7C:
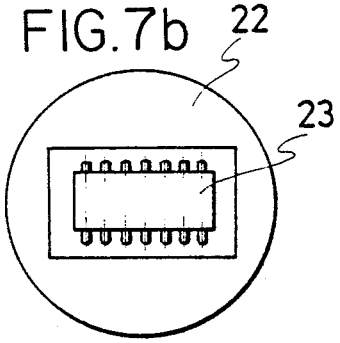

FIG. 6 is a longitudinal sectional view through a key receiver illustrating a magnetic or magnetisable piece 14, passive relays 15, a connector 16, connections 17 of the passive relays to the connector and output cables 18 having any suitable length. Elements 14*a*, 14*b*, 14*c*, 14*d* and 14*e* are magnetic or magnetisable pieces located at positions corresponding to a key receiver used for a large number of them.

FIG. *7a* illustrates a circuit-connector 19 which may or may not be attached to the key receiver, but in any case which is joined to the terminals (connector 16) of the passive relays to determine the correct combination of the key. The circuit-connector can have any desired shape, the circular shape illustrated in FIG. *7b* being a type having a notch 20 which permits, from the point of view of economy of manufacture, multiple key codes to be achieved in the same way as some modules are turned or dephased with respect to others in the construction of the key body, due to turn or dephase of the circuit-connector. The strips of the printed circuit or the connections of the code are indicated as 21. FIG. *7c* illustrates at 22 a circuit-connector comprised of a circuit including a memory 23 which incorporates the correct code. Programming of this circuit takes place by a microprocessor connected to a key receiver which determines the code thereof when it is introduced and the corresponding memory records, thus minimizing the manufacturing process of the printed circuit or manufacture of the connections of the code.

FIG. 8 illustrates a key receiver 28 in the case of a backed circuit-connector 19 without a lead. System A supplies the assembly through a power source to a circuit 24 which provides voltage to an opening bolt 26 in case of a correct code due to the instructions received from the key receiver. In the case of an incorrect combination, an alarm 27 and/or an element 25 which blocks the system is fed. The circuit 24 will provide a in actuation prior to the complete insertion of the key to prevent speedy and erroneous replies on the part of the key receiver when actuated partially.

The decodification system can be formed of a single logic circuit as illustrated in FIG. 9, wherein D represents "1" inputs generated by the passive relays of the key receiver which, with the activation of only one of them, generates an "0" in an output B of the a NOR gate 28, activating an alarm by output B and preventing a "1" output from a gate 30 which excites a gate 32 and actuates an opening system by output C e.g. bolts. All inputs E, which are generated by the key, should be a "1" so that a gate 29 of the AND type outputs a "1" and activates the gate 30 and therewith the gate 32 and the opening of the bolts by output C. Inputs F are generated by a combination of passive relays, all of which should give a "1" for the activation of an AND gate 31 and which should give the output of "1" which activates gate 32 to effect opening. These inputs F generated by the corresponding passive relays are common to a considerable number of locks and are, therefore, a guide combination thereof. The corresponding key will be the guide for the system.

Another practical application can be that illustrated in FIG. 10, where there is represented a bolt-type locking system in which 33 is the key, 34 the key receiver, 35 the key decodifier which activates an electromagnet 36 which displaces a pinion 37 which, in turn, overcomes a spring 38, causing pinion 37 to mesh with pinions 39 and 40 and which, when the key turns, pulls a bolt 41 to achieve opening. A handle 42 permits opening from the inside without activating the lock. In this case the key should be turned cause mechanical movement, but, in the majority of the cases turning of the key is not necessary and an electromagnet moves the bolt directly.

All the magnetic or magnetisable pieces, mentioned and represented in the drawings, are of soft iron or materials having like properties and/or permanent magnets and/or electromagnets fed by the network through the self-generating source with batteries and are used both in the key body and in the key receiver.

I claim:

1. In an magnetoelectronic lock comprising a key body having a magnetic combination, a receiver of the key body in the interior of which there are arranged magnetic detectors, a bolt, and an electronic circuit device connected between the bolt and the detector, the improvement comprising: positive and negative magnetisation means which cooperate, depending on the position thereof, in the electric conduction, opening, closing or blocking of an electronic circuit including an electric opening pulse of a gate; a means for determining the electric continuity both in the key and in the receiver thereof; an electric derivation means for opening the code; passive positive and negative relay means in combination with positive and negative magnetic elements; positive and negative magnetic means whose potentials act on the passive relays in the contact threshold; positive and negative magnetic means which, in combination by proximity to the passive relays, act on them with an opposite polarity maintaining them static with respect to their means potential, changing the conduction state thereof when magnetic elements having a higher potential are juxtapositioned; and a multiple contact connector means capable of being combined with the key.

2. A magneto-electronic lock according to claim 1, wherein said positive and negative magnetisation means are small magnetic elements having a permanently magnetised potential which, when facing, by juxtaposition, antagonistic elements arranged in the receiver of the key body, produce the electrical continuity, closing said circuit to cause opening of the gate.

3. A magneto-electronic lock according to claim 1, wherein said magnetic detectors are passive relays disposed on a support, the terminals of which are oriented in a single direction so as to be electrically connected from the outside thereof.

4. A magneto-electronic lock according to claim 1, wherein said magnetic detectors are integrated passive relays, disposed on a support or a continuous printed circuit strip, being fixed to said support or strip by either soft soldering therebetween or by integration.

5. A magneto-electronic lock according to claim 4, wherein magnetic elements having a positive or negative charge are arranged on the support or continuous strip, close to the passive relays, so as to increase or reduce their electric contact threshold.

6. A magneto-electronic lock according to claim 5, wherein said magnetic elements are disposed on the same layer of passive relays or on successive layers of the receiver body of the key, so as to increase or reduce said electric contact threshold.

7. A magneto-electronic lock according to claim 4, wherein said passive relays are arranged on the support or printed circuit strip parallel to the electrical connection thereof.

8. A magneto-electronic lock according to claim 4, wherein said passive relays are arranged on the support or printed circuit strip parallel to the electric connection thereof or they are series connected.

9. A magneto-electronic lock according to claim 4, wherein when the key body is introduced in the receiver thereof, the electrical continuity only exists in the connecting terminals of the multiple connector for supplying the electronic circuit, when the juxtapositions of the magnetic elements coincide both in polarity and in intensity with the arrangement of the passive relays disposed on the support or strip of the key receiver.

10. A magneto-electronic lock according to claim 1, wherein the combinations of the key element depend on the number, size, polarity and potential of the plurality of magnetic elements incorporated in said key body.

11. A magneto-electronic lock according to claim 1, wherein the element or key body is a cylinder provided with one or more layers of magnetic elements arranged either longitudinally or radially, adjacent or alternately in the form of a packet, whose outer surface comprises a friction-resistant and non-magnetisable material.

12. A magneto-electronic lock according to claim 1, wherein said key body is constituted by a positive geometry with respect to the negative geometry presented by the key receiver for the introduction and coincidence of the magnetic elements of the key, with positive relay elements and/or magnetic elements or the combination of the receiver of the key.

13. A magneto-electronic lock according to claim 1, wherein said key body is comprised of a flat card-like surface.

14. A magneto-electronic lock according to claim 1, wherein multiple connecting means are disposed at the output of the terminals of the receiver body of the key, joining, by electric conductors, the input and output voltages to the electronic circuit which opens the gate.

15. A magneto-electronic lock according to claim 1, wherein the input and output voltage to the electronic circuit which opens the gate establishes the logic sequence in the pre-established program of the electronic circuit for activation thereof.

16. A magneto-electronic lock according to claim 14, wherein said multiple connecting means stores the opening code by means of an electric connection, depending on the code of the key.

17. A magneto-electronic lock according to claim 1, wherein during the introduction of the key, the reading of the code is either sequential, or static or a combination of sequential and static.

18. A magneto-electronic lock according to claim 1 wherein the body and/or the key receiver is provided with micro-electromagnets whose activation depends on a reference voltage both in the body of the same key, a self-generating power source, or is derived from the key receiver once situated in the opening position.

19. A magneto-electronic lock according to claim 1, wherein said original permanent magnets, which are totally or partially or non-magnetised, prior to or subsequent to the assembly thereof, are in part or in whole the magnets of the key.

* * * * *